US005664730A

United States Patent [19]

Vallières et al.

[11] Patent Number: 5,664,730

[45] Date of Patent: Sep. 9, 1997

[54] HUMIDIFIER DEVICE

[75] Inventors: Jean-P. Vallières, Lavaltrie; Jean-Guy Vallières, Brossard, both of Canada

[73] Assignee: Technov International Inc., Mt-St-Hilaire, Canada

[21] Appl. No.: 639,464

[22] Filed: Apr. 29, 1996

[51] Int. Cl.[6] ..... F24F 3/14

[52] U.S. Cl. ..... 237/78 R; 237/78 A; 237/78 B

[58] Field of Search ..... 237/78 R; 392/390; 261/113

[56] References Cited

U.S. PATENT DOCUMENTS 4,768,707 9/1988 Vanderlinden ..... 237/78 A

*Primary Examiner*—Henry A. Bennett
*Assistant Examiner*—Derek S. Boles
*Attorney, Agent, or Firm*—François Martineau

[57] ABSTRACT

The invention discloses a humidifying device which consists in a thermally conductive casing which is adapted and correctly dimensioned to fit over a conventional electrical radiator without preventing it from heating the ambiant air simultaneously. The casing is destined to be at least partially filled with water, and upon the radiator generating heat, the water temperature will gradually increase and water will evaporate into the ambiant air through outlets in the top of the casing due to the heat being conducted through the radiator and casing to the water. The water vapor outflow rate can be selectively adjusted by means of a pivotable heat deflector or alternately by adjusting the distance between the radiator and the casing. A sponge member filled with bactericide is inserted into the casing and is submerged in water.

14 Claims, 3 Drawing Sheets

HUMIDIFIER DEVICE

FIELD OF THE INVENTION

The present invention relates to a humidifying device, and more particularly to a water-filled casing heated by means of a conventional radiator.

BACKGROUND OF THE INVENTION

Lack of humidity in household ambiant air can cause several minor physical disabilities which can be very unpleasant to the house inhabitants, such as allergies and nose bleeding. To counter this lack of humidity, it is known to install either a portable humidifier in one or more rooms, or to combine the house heating system with a main humidifier if the heating system uses air conveying ducts.

The problem with the portable humidifier is that its efficiency/price ratio can be very poor. Indeed, the water poured into the humidifier must be heated until it evaporates, and a water heater must thus be included within the humidifier, this to humidify only one room.

To combine a humidifier to the main heating system can indeed become a very costly solution, for the size of this system can be very important.

OBJECT OF THE INVENTION

It is the object of the invention to provide a humidifier that can be removably added to a conventional room radiator for a water vapor outflow into the ambiant air.

SUMMARY OF THE INVENTION

The present invention relates to a casing yto be filled with water that can be removably installed on a conventional electric or air duct radiator for generating heat and humidifying the ambiant air with only one power input, namely the heat-generating radiator.

This synergy of the water casing and the radiator is particularly advantageous, in that:

a) only one power means is necessary to both generate convection heat and air humidification;

b) a conventional domestic heating apparatus, such as an electric baseboard radiator, can be used to this end; and c) the production cost of the humidifier-casing is very low, since no electrical or other power means are included, only a simple metallic casing (possibly together with the bactericidal sponge member).

More particularly, the air humidifying device of the invention comprises:

a) a radiator, having heat releasing means for generating heat, and a load bearing surface;

b) a thermally conductive casing comprising: a wall member releasably mounted to said load bearing surface of said radiator and correctly dimensioned to conformingly fit thereon; an inner chamber, for receiving and enclosing water, said inner chamber being positioned spacedly over said load bearing surface; water vapor outlet means, for escape of water vapor from said inner chamber upon the water being heated by said radiator; and adjustment means, for selectively adjusting the water vapor escape rate for a given temperature level;

wherein heat transfer occurs through said casing between said radiator and the water inside said inner chamber upon said radiator generating heat, the water consequently gradually increasing in temperature and evaporating into the ambiant air.

Preferably, the air humidifying device further comprises a sponge member inside said casing destined to be at least partially submerged in the water, said sponge member containing a bactericide for substantially preventing microbial growth inside the inner chamber water.

Advantageously, said adjustment means comprises adjustable spacer members located between said casing wall member and said radiator load bearing surface, for selectively adjusting the distance of said casing relative to said radiator, whereby a water vapor flow rate escaping through said outlet means can be selected, said wall member thus being mounted to said load bearing surface through the instrumentality of said spacer members.

Preferably, said spacer members are elongated rigid strips inserted between said radiator load bearing surface and said casing, said strips having a selected height corresponding to the selected water vapor flow rate.

Alternately, said spacer members are semi-spherical support feet resting on said radiator load bearing surface and adjustably engaging said casing for selecting the relative distance of said casing relative to said radiator, corresponding to the selected water vapor flow rate.

Alternately, said casing further comprises air channel means and a transfer wall member between said air channel means and said inner chamber, a hot air flow being created by the radiator and being destined to at least partially pass through said air channel means, whereby the heat of the hot air flow is partially conducted through said transfer wall member and to the water.

Alternately, said adjustment means comprises an adjustable deflector member located in said air channel means, said deflector member deflecting a selected portion of the hot air flow generated by said radiator away from said transfer wall member, whereby a water vapor flow rate escaping through said outlet means can be selected.

DETAILED DESCRIPTION OF THE EMBODIMENTS

Figure 1:
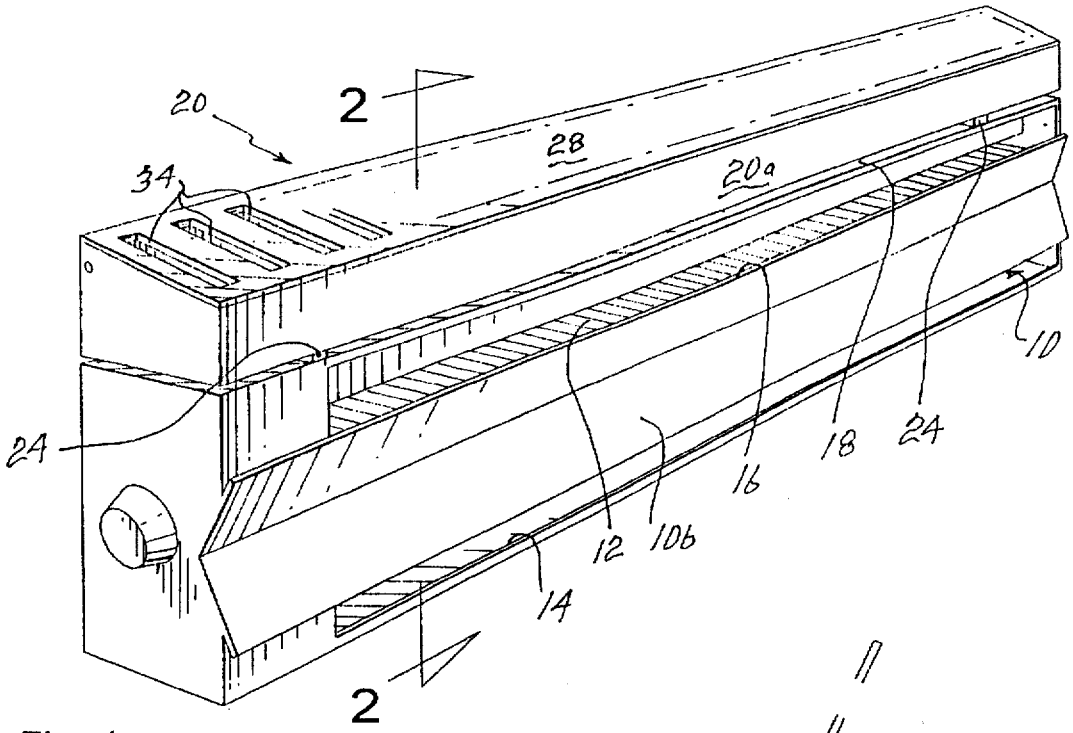
FIG. 1 is a perspective view of a first embodiment of the humidifying device according to the invention, together with a conventional electric baseboard radiator.
Figure 2:
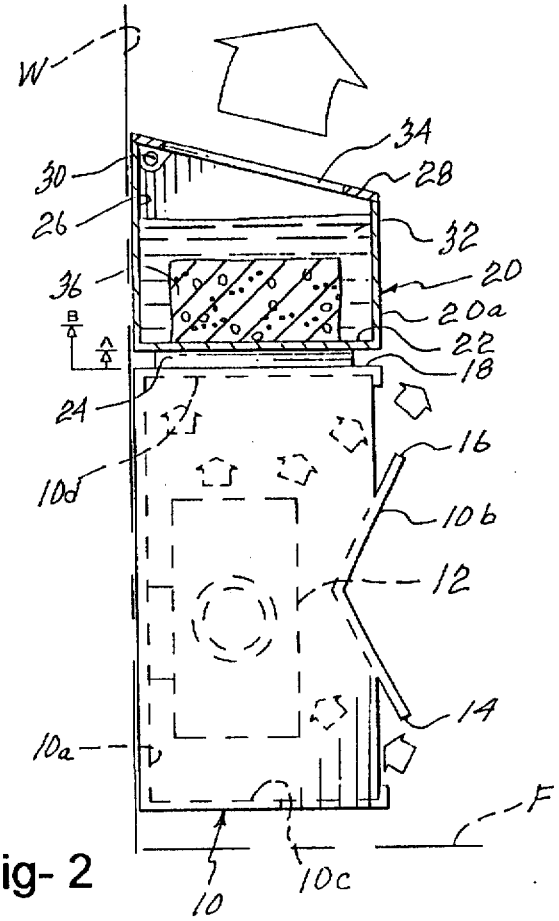
FIG. 2 is a cross-sectional view at an enlarged scale taken along line 2—2 of FIG. 1.

FIGS. 1 and 2 show a conventional electric baseboard radiator 10 which is made of a thermally conductive material and which has heat releasing members, in the form of a number of spaced-apart electrically heated fins 12, as is known in the art. Radiator 10 defines a rear flat wall 10*a* adapted to be fixedly attached to the upright wall W of a room, a front elbowed wall 10*b* opposite rear wall 10*a*, a flat bottom wall 10*c* spacedly proximate the floor F of said room, and a top wall 10*d* opposite bottom wall 10*c*. The cooler air enters through a lower opening 14 in front wall 10*b*, is heated by the heat-generating fins 12 and exits through an upper opening 16 in front wall 10*b*, as suggested by the small arrows of FIG. 2. The upper wall 10*d* has an outer substantially flat and horizontal load bearing surface 18.

An elongated and substantially rectangular casing 20 is positioned over radiator 10, defining a lower wall member 22 under which are releasably attached a pair of spacer members 24 which rest on radiator load bearing surface 18. Spacer members 24 are elongated blocks which are releasably installed widthwisely and in spaced-apart fashion along casing 20 to support the latter vertically spaced over radiator 10. The thickness of spacer members 24 may be selected so as to adjustably position casing 20 over radiator 10 at a desired height, as suggested with two possible heights A and B of spacers 24 in FIG. 2.

Casing 20 is correctly dimensioned and adapted to fit over radiator 10 without extending beyond it sideways, backwards or frontwards. Thus, it is not in the way and is not prone to being inadvertently struck by people walking near radiator 10.

Casing 20 further defines an inner chamber 26 and a cover panel 28 hinged to rear wall 26 at its rear edge at 30. Thus, cover panel 28 can be pivotally opened to gain free access to inner chamber 26 which is destined to be at least partially filled with water 32, up to a maximum level which is approximately shown in FIG. 2, so as not to overflow over the lowest side wall of casing 20, namely the front wall 20*a*. Cover panel 28 has a plurality of slots 34 (FIG. 1) on all of its surface that act as a water vapor outlet.

Casing 20 is made of a thermally conductive material, for example metal.

In use, when radiator 10 generates heat, it is partially conducted through radiator upper wall 10*d* and casing lower wall member 22 and consequently the water 32 inside upper reservoir 20 is heated in this way, and gradually evaporates into the ambiant air, as suggested by the large arrow in FIG. 2, through slots 34 of cover panel 28. Only a portion of the heat generated by radiator 10 is used to heat water 32, since most of said heat will exit radiator 10 through upper opening 16, to heat the ambiant air.

An elongated sponge member 36 can be included into inner chamber 26 to rest on lower wall member 22, thus being at least partially submerged in water. Sponge member 36 contains a bactericide to prevent microbial growth inside reservoir 20. The bactericide is poured into the sponge member and not mixed directly into the water, to be gradually released into the water (so as not to evaporate just after having been poured).

The water-containing casing 20 thus takes advantage of the heat which is generated by radiator 10 to evaporate the water 32 into the ambiant air. This synergy of water casing 20 and radiator 10 is particularly advantageous, in that:

a) only one power means is necessary to both generate convection heat and air humidification;

b) a conventional domestic heating apparatus, such as an electric baseboard radiator, can be used to this end; and c) the production cost of the humidifier-casing is very low, since no electrical or other power means are included, only a simple metallic casing (possibly together with the bactericidal sponge member).

Figure 3:
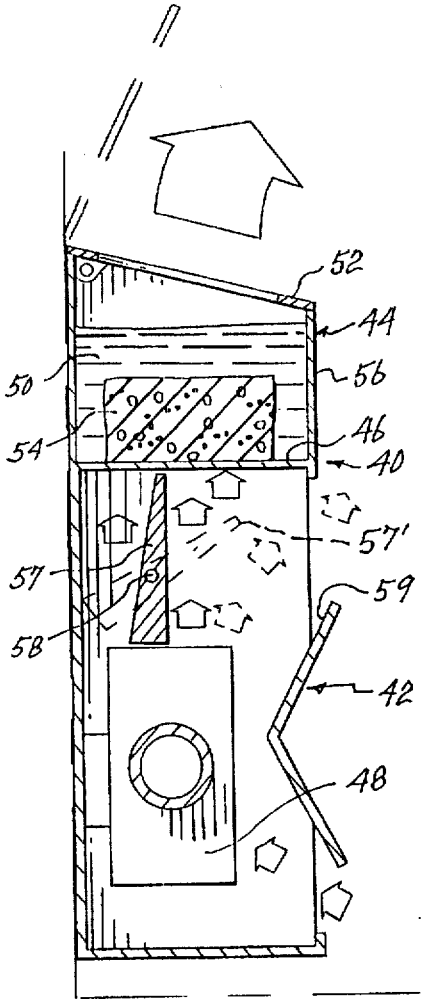
FIG. 3 is a view similar to FIG. 2, but showing a second type of electric heater.

FIG. 3 shows a second embodiment of the invention which is similar to the embodiment of FIGS. 1 and 2. However, in this embodiment, the thermally conductive humidifying device 40 is a made of a single unit comprising a radiator portion 42 positioned under and integrally connected to a water-containing casing 44, radiator 42 and casing 44 sharing a common horizontal wall member 46. As with the first embodiment of the invention, heat is generated and spread by means of fins 48 and is partly conducted through wall member 46 to heat the water 50 inside reservoir 44. Thus, some water vapor escapes through the vapor outlet of the cover panel 52. A bactericidal sponge member 54 can also be provided in the inner chamber 56 of casing 44.

A substantially rectangular deflector 57 is longitudinally installed over fins 48 and is selectively pivoted transversely along horizontal axle 58 by means of a knob (not shown) positioned on one side of radiator 42 and integrally and coaxially linked to pivot 58. Deflector 57 can be pivoted between an upright position (in full lines in FIG. 3), in which the heat generated by fins 48 can freely reach wall member 46, and an inclined position 57' (in dotted lines in FIG. 3), in which an important portion of the heat is deflected away from wall member 46 and towards the radiator upper opening 59. Consequently, the warm air flow rate towards top wall member 46 can be selectively adjusted, and the heating rate of water 50 and the evaporation rate, controlled.

Figure 4:
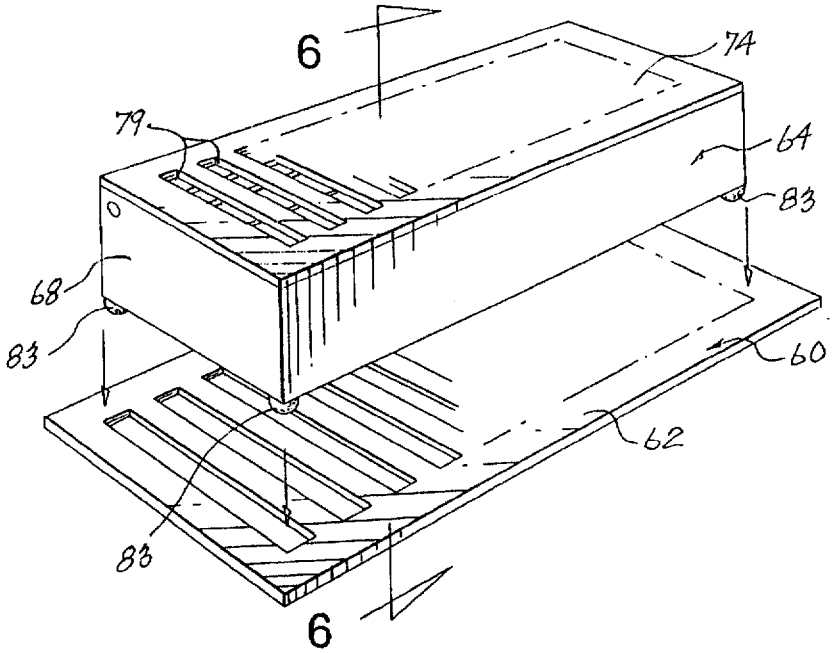
FIG. 4 is a perspective view of another embodiment of a humidifying device according to the invention, together with a conventional floor air duct radiator.
Figure 5:
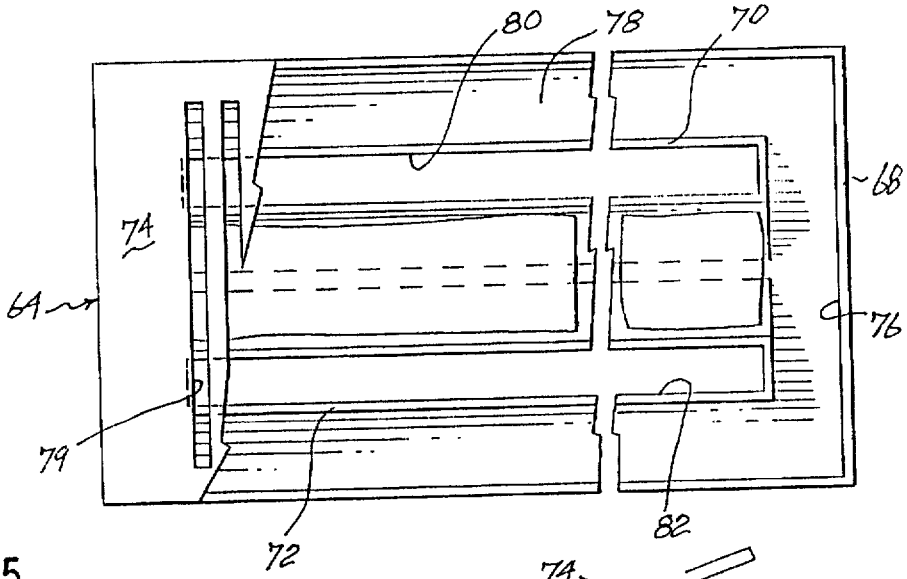
FIG. 5 is a top plan view, partly broken, of the humidifying device of FIG. 4.
Figure 6:
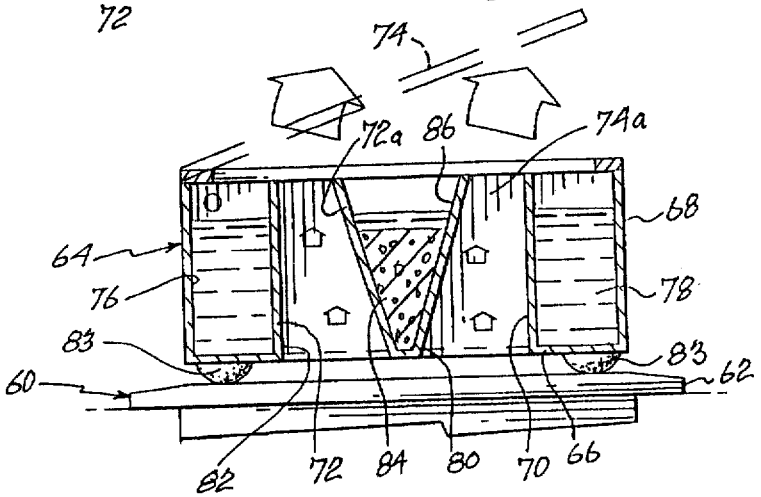
FIG. 6 is a cross-sectional view taken along line 6—6 of FIG. 4, and suggesting how access to the humidifying device can be achieved through a top gate.

FIGS. 4 to 6 show a third embodiment of the invention.

A conventional rectangular floor air duct radiator 60 comprises an air output covered by a protecting grate 62, the air output creating an upward hot air outflow. The air humidifying device according to the invention comprises a rectangular thermally conductive box-like casing 64 correctly dimensioned and adapted to fit over grate 62.

Casing 64 defines a bottom wall 66, a peripheral side wall 68, two substantially rectangular tapered hollow inner walls 70, 72 and a top cover panel 74 hinged at one of its edges to peripheral wall 68, whereby pivoting cover panel 74 in opened position (FIG. 6) gives free access to an inner chamber 76 defined by bottom wall 66, peripheral wall 68 and inner walls 70, 72. Inner chamber 76 is at least partially filled with water 78, the water being free to spread itself around the whole inner chamber 76 since radially inner walls 70, 72 are spaced from peripheral wall 68 and from one another and do not form any barrier to the water.

Cover panel 74 has a plurality of parallel slots or openings 79, only a fraction of the total number thereof being illustrated in FIG. 4 for clarity of the view.

Bottom wall 66 has a pair of rectangular openings 80 and 82 at the periphery of which originate inner walls 70 and 72, respectively. Inner walls 70, 72 thus form air channels through which an important part of the hot air flowing out of air duct 60 passes to reach the room, the cover panel openings 79 allowing this air passage. Preferably, and as shown in the embodiment of FIGS. 4 to 6, at least one portion of the inner walls 70, 72 slopes inwardly, relative to the air channel, so as to create a convergent air channel towards cover panel 74: in this case, the radially inward portion 72*a*, 74*a* of inner walls 72, 74 slopes in this way, the surface of wall portions 72*a*, 74*a* being positioned vertically over air duct 60 and thus being in the path of the hot air outflow for an enhanced heat transfer. Upwardly and outwardly sloped wall portions 72*a*, 74*a* give inner walls 72, 74 their tapered appearance.

Casing 64 is supported spacedly over grate 62 by means of four semi-spherical support feet 83 positioned at the four corners of bottom wall 66 and fixedly attached thereto, bottom wall 66 and feet 83 forming a wall member engaging the upper substantially flat load bearing surface of grate 62. Preferably, the length of feet 83 can be adjusted through adjustment means; for example, feet 83 could threadingly engage bottom wall 66 with a screw member which would be selectively more or less inserted into wall member 66 to adjust the distance at which casing 64 is to be positioned relative to grate 62.

In use, the hot air flows through the air channels formed by inner walls 72, 74 and the heat thus generated in the air channels is conducted through inner walls 70, 72 and through bottom wall 66 to water 78, the latter gradually evaporating into the room. Sloped wall portions 72*a*, 74*a* substantially help to increase the heat transfer towards inner chamber 56 due to their sloped position in the vertical path of the warm air outflow.

Feet 83 offer a certain adjustment of the water vapor outflow rate by selecting the distance separating casing 64 and grate 62. If casing 64 is very close to grate 62, then the air is still very hot and most of it is forced to either come into contact with bottom wall 66 or to pass through the air channels formed by inner walls 72, 74: this way, the heat transfer will be more important. However, if casing 64 is positioned further away from grate 62, then the air outflow is cooler when it reaches casing 64, and a more important part of this air outflow may escape around casing 64 without coming into contact with it.

As with the other embodiments of the invention, a sponge member containing a bactericide can be inserted in inner chamber 76 to be at least partially submerged in water. In this case, the sponge member 84 is positioned in the center portion of inner chamber 76 in a V-shaped inner channel 86 defined by sloped wall portions 72*a*, 74*a*, to benefit from the enhanced heat transfer in this portion of inner chamber 76.

Figure 7:
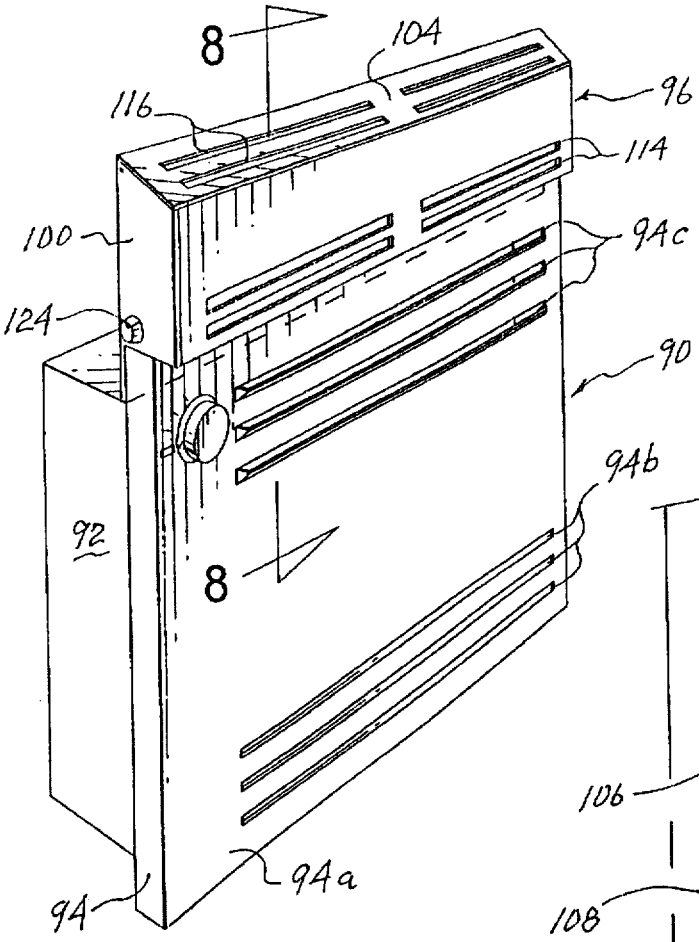
FIG. 7 is a perspective view of another embodiment according to the invention, mounted on a wall radiator.
Figure 8:
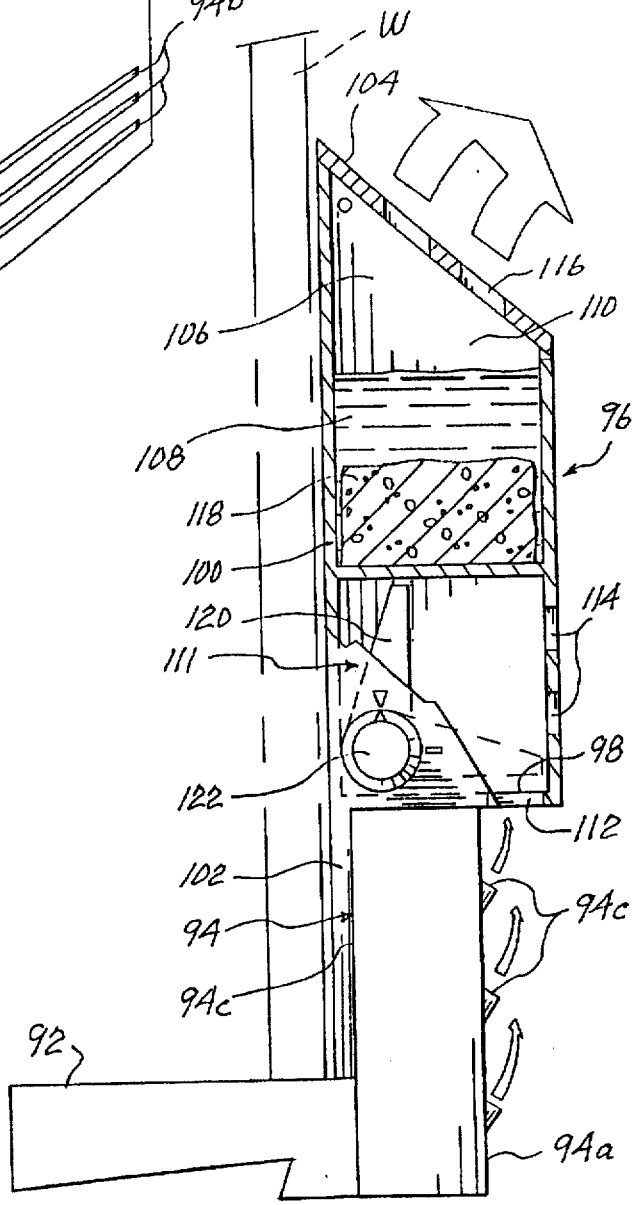
FIG. 8 is a cross-sectional view, at an enlarged scale, taken along line 8—8 of FIG. 7.

FIGS. 7 and 8 show a fourth embodiment of the invention.

A wall radiator 90 has a main body 92 and a front portion 94 larger and thinner than main body 92. Main body 92 can be either fixed on an upright wall surface or inserted into a correctly dimensioned hole in a wall W', as suggested in FIG. 8, with front portion 94 being slightly offset relative to wall W' so as to protrude into the room bounded wall W'.

Front portion 94 defines a front surface 94*a* having cool air input lower openings 94*b* and warm air outlet upper openings 94*c*. The cool air is sucked in through lower openings 94*b*, warmed inside front portion 94 and blown out through upper openings 94*c* which are upwardly sloped so as to direct the outcoming warm air upwards.

Front portion 94 further defines an upper surface 94*d* (FIG. 8) and a rear surface 94*e*, upper and rear surfaces 94*d* and 94*e* forming a load bearing surface on which a humidifier casing 96 rests. Indeed, casing 96 has a flat bottom wall 98 which rests on flat radiator upper surface 94*d*. Also, it has a substantially rectangular hollow upright peripheral wall 100 from the rear surface of which projects a downwardly extending lip 102 which is to be attached to radiator rear surface 94*e*: lip 102 is thus inserted between radiator front portion 94 and wall W'. Bottom wall 98 and lip 102 form a right angle wall member which engages the radiator load-bearing surface.

The rear portion of peripheral vertical wall 100 is shown to be higher than the front portion thereof, and an inclined cover panel 104 is hinged at the rear upper edge of peripheral wall 100, so as to be pivotable between a closed position (shown in FIGS. 7 and 8) and an opened raised position (not shown) that allows free access into an inner chamber 106 that is destined to be at least partially filled with water 108. Inner chamber 106 is defined by peripheral wall 100 and an inner wall 110 dividing casing 96 approximately in two halves along a horizontal plane. A lower air channel chamber 111 is concurrently formed beneath inner chamber 106 by inner wall 110, bottom wall 98 having a longitudinal air input opening 112 and the front surface of peripheral wall 100 having several air output openings 114 that allow an air flow through air channel chamber 111.

In use, the hot air coming out of radiator upper openings 94*c* partially enters air input opening 112 and flows into lower air channel chamber 111 and out through air output openings 114'. The heat from the warm air will partially be conducted through inner wall 110 and to the water 108 in inner chamber 106. The water will thus gradually evaporate and escape through openings 116 in cover panel 104 to humidify the ambiant air.

Again, a sponge member 118 containing a bactericide is at least partially submerged in water in inner chamber 106.

A substantially rectangular deflector 120 is longitudinally installed near the lower rear edge of lower air channel chamber 111 and is selectively pivotable at 122 by means of a knob 124 positioned on the exterior side of peripheral wall 100. Deflector 120 is sized so that it can be pivoted between an upright position (FIG. 8), in which the warm air can freely flow through air channel chamber 111, and a horizontal position (not shown) in which it seals opening 112 to prevent the warm air from entering air channel chamber 111. Thus, the warm air inflow rate can be selectively adjusted, and the heating rate of water 108 and consequently the evaporation rate into the ambiant air are controlled.

It is understood that the advantages of the second, third and fourth embodiments of the invention are the same as the ones described for the first embodiment, namely:

a) only one power means is necessary to both generate air convection heat and humidify the air;

b) a conventional domestic heating apparatus, such as any of the above-described radiators, can be used to this end; and c) the production cost of the humidifier-casing is very low, since no electrical or other power means are included, only a simple metallic casing (possibly together with the bactericidal sponge member).

It can thus be seen that the humidifying device of the invention can be adapted, with a few modifications to the shape or design of the water-holding casing, to radiators of different sizes, shapes and locations. Consequently, although only four such humidifying devices have been shown, any such device which is considered to act in a similar manner but which differs from any of the above-described devices in its shape or design, is considered to be within the scope of this invention.

Concerning the embodiment of FIG. 4, a large collar (not shown) is preferably mounted fixedly beneath the unit 64; this collar will be used to anchor the unit 64 into a complementarily-shaped groove in the ground.

We claim:

1. An air humidifying device comprising:

a) a radiator, having heat releasing means for generating heat, and a load bearing surface;

b) a thermally conductive casing comprising: a wall member releasably mounted to said load bearing surface of said radiator and correctly dimensioned to conformingly fit thereon; an inner chamber, for receiving and enclosing water, said inner chamber being positioned spacedly over said load bearing surface; water vapor outlet means, for escape of water vapor from said inner chamber upon the water being heated by said radiator; and adjustment means, for selectively adjusting the water vapor escape rate for a given temperature level;

wherein heat transfer occurs through said casing between said radiator and the water inside said inner chamber upon said radiator generating heat, the water consequently gradually increasing in temperature and evaporating into the ambiant air; wherein said adjustment means comprises adjustable spacer members located between said casing wall member and said radiator load bearing surface for selectively adjusting the distance of said casing relative to said radiator, whereby a water vapor flow rate escaping through said outlet means can be selected, said wall member thus being mounted to said load bearing surface through the instrumentality of said spacer members.

2. An air humidifying device as defined in claim 1, further comprising a sponge member inside said casing destined to be at least partially submerged in the water, said sponge member containing a bactericide for substantially preventing microbial growth inside the inner chamber water.

3. An air humidifying device as defined in claim 1, wherein said spacer members are elongated rigid strips inserted between said radiator load bearing surface and said casing, said strips having a selected height corresponding to the selected water vapor flow rate.

4. An air humidifying device as defined in claim 1, wherein said spacer members are semi-spherical support feet resting on said radiator load bearing surface and adjustably engaging said casing for selecting the relative distance of said casing relative to said radiator, corresponding to the selected water vapor flow rate.

5. An air humidifying device as defined in claim 1, wherein said casing further comprises air channel means and a transfer wall member between said air channel means and said inner chamber, a hot air flow being created by the radiator and being destined to at least partially pass through said air channel means, whereby the heat of the hot air flow is partially conducted through said transfer wall member and to the water.

6. An air humidifying device as defined in claim 5, wherein said adjustment means comprises an adjustable deflector member located in said air channel means, said deflector member deflecting a selected portion of the hot air flow generated by said radiator away from said transfer wall member, whereby a water vapor flow rate escaping through said outlet means can be selected.

7. A thermally conductive humidifier casing for use with a radiator of the type having a load bearing surface and heat releasing means for generating heat, said humidifier casing comprising: a wall member to be releasably mounted to the load bearing surface of the radiator; an inner chamber, for receiving and enclosing water, said inner chamber being destined to be positioned spacedly over said load bearing surface; water intake means, for engagement of the water inside said inner chamber; water vapor outlet means, for escape of water vapor from said inner chamber upon the water being heated by the radiator; and adjustment means, for selectively adjusting the water vapor escape rate for a given temperature level;

wherein heat transfer occurs through said casing between the radiator and the water inside said inner chamber upon the radiator generating heat, the water consequently gradually increasing in temperature and evaporating into the ambiant air; wherein said adjustment means comprises adjustable spacer members located between said casing wall member and the radiator load bearing surface, for selectively adjusting the distance of said casing relative to the radiator, whereby a water vapor flow rate escaping through said outlet means can be selected, said wall member thus being mounted to the load bearing surface through the instrumentality of said spacer members.

8. A humidifier casing as defined in claim 7, further comprising a sponge member inside said casing destined to be at least partially submerged in water, said sponge member containing a bactericide for substantially preventing microbial growth inside said inner chamber water.

9. A humidifier casing as defined in claim 8, wherein said spacer members are elongated strips destined to be inserted between the radiator load bearing surface and said casing, said strips having a selected height corresponding to the selected water vapor flow rate.

10. A humidifier casing as defined in claim 8, wherein said spacer members are semi-spherical support feet destined to rest on the radiator load bearing surface and adjustably engaging said casing for selecting the relative distance of said casing relative to the radiator, corresponding to the selected water vapor flow rate.

11. A humidifier casing as defined in claim 7, wherein said casing further comprises air channel means and a transfer wall member between said air channel means and said inner chamber, a hot air flow being created by the radiator and being destined to at least partially pass through said air channel means, whereby the heat of the hot air flow is partially conducted through said transfer wall member and to the water.

12. A humidifier casing as defined in claim 11, wherein said adjustment means comprises an adjustable deflector member located in said air channel means, said deflector member deflecting a selected portion of the hot air flow generated by said radiator away from said transfer wall member, whereby a water vapor flow rate escaping through said outlet means can be selected.

13. An air humidifying device comprising a radiator and a casing having a thermally conductive common wall member, said radiator having heat releasing means for generating heat, said casing comprising: an inner chamber, for receiving and enclosing water; water intake means, for engagement of the water inside said inner chamber; and water vapor outlet means, for escape of water vapor from said inner chamber upon water being heated by said radiator; said humidifying device further comprising adjustment means, for selectively adjusting the water vapor escape rate;

wherein heat transfer occurs through said wall member between said radiator and the water inside said inner chamber upon said radiator generating heat, the water consequently gradually increasing in temperature and evaporating into the ambiant air; further comprising a sponge member inside said casing destined to be at least partially submerged in water, said sponge member containing a bactericide for substantially preventing microbial growth inside the water of said inner chamber.

14. An air humidifying device as defined in claim 13, wherein said adjustment means comprises an adjustable deflector member located in said radiator, for deflecting a portion of the upcoming heat generated by said radiator away from said inner chamber, whereby a water vapor flow rate escaping through said outlet means can be selected.

* * * * *